United States Patent [19]

Elliott

[11] 4,006,886

[45] Feb. 8, 1977

[54] SOIL COMPACTING DEVICES

[75] Inventor: Roger Michael Elliott, Ipswich, England

[73] Assignee: B S P International Foundations Limited, Ipswich, England

[22] Filed: Jan. 13, 1976

[21] Appl. No.: 648,630

[30] Foreign Application Priority Data

Jan. 15, 1975 United Kingdom ..... 1769/75

[52] U.S. Cl. ..... 259/1 R; 259/DIG. 43

[51] Int. Cl.[2] ..... B01F 11/00; E02D 3/06

[58] Field of Search ..... 259/1 R, DIG. 41, DIG. 42, 259/DIG. 43, DIG. 44, 183; 404/115, 116

[56] References Cited

UNITED STATES PATENTS

| | | | |
|---|---|---|---|
| 2,116,708 | 5/1938 | Niekamp | 259/DIG. 41 |
| 3,061,278 | 10/1962 | Dreyer | 259/DIG. 41 |
| 3,782,693 | 1/1974 | Strohbeck | 259/DIG. 41 |

*Primary Examiner*—Harvey C. Hornsby
*Assistant Examiner*—Alan Cantor
*Attorney, Agent, or Firm*—Larson, Taylor and Hinds

[57] ABSTRACT

A soil compacting device has a vibrator unit dependent from a follower tube and so connected thereto as to be able to swing transversely relative to the tube. The connection is effected by at least one internally disposed flexible tension element such as a rope or cable. A resilient sleeve forms a seal between the adjacent ends of the vibrator unit and the follower tube and restrains relative rotation therebetween. The sleeve is pre-compressed by the tension in the wire or rope. The vibrator unit, sealing sleeve and follower tube form an elongated cylinder-like assembly with a substantially uniform cross-section.

9 Claims, 2 Drawing Figures

SOIL COMPACTING DEVICES

BACKGROUND OF THE INVENTION

This invention relates to soil-compacting devices of the kind comprising a body containing a vibratory mechanism and arranged to be introduced into or to form a hole in the ground, such as may be required to receive piling or other building foundation works.

Such devices are commonly of elongate form to facilitate the compaction process and for better guidance of the device along a straight path. To obtain a desirable overall length without attenuating the effect of the vibratory mechanism unduly, it is known to couple the body containing the mechanism with a follower that forms an upward extension of the body, the coupling being designed so as to reduce the transmission of vibrations from the vibrator body to the follower.

The coupling is required to support the vibrator body from the follower, at least when the device is suspended above a hole, and it must also not allow the body to rotate freely because pipelines and cables extending through the follower into the body, e.g. to power the vibratory mechanism, would then become twisted. It is not easy to combine these requirements with the need to minimize the transmission of vibrations from the body to the follower and also to provide sufficient internal space in the coupling for the passage of pipelines and cables. The result has been a compromise in which some of the desired results are sacrificed.

Thus, UK patent specification No. 1 278 696 describes the use of a series of universal couplings to connect the vibrator body and follower tube in a way that allows relative lateral displacements, but the couplings are bulky and restrict substantially the space available for the required pipelines and cables and the components of the universal couplings are susceptable to accelerated wear in the dirty working conditions to which they are exposed.

In UK patent specification No. 987 312 there is described an arrangement in which the body is suspended through resilient rings bonded to the body and the follwer, at frusto-conical interfaces. This arrangement relies on the supposition that the body moves as a conical pendulum about a vertical centre defined by the apex of the conical surface normal to said interfaces, but the restraints imposed by the walls of the hole in which the compacting device is working can prevent this, and since soil conditions will normally vary consierably and unpredictably it is impossible to make allowance for their effect. Any such deviations will render the resilent rings ineffective for their intended function of isolating the follower from the vibrations.

The known construction also requires that the vibrator body can be suspended from the follower through the rings,and therefore through their bonded faces. Even when the weight of the vibrator body is taken by the bottom of the hole, it is still necessary for the bonding to allow for stress reversals leading to very substantial tensile stresses because of the movements of the coupling when the body oscillates angularly with respect to the follower. It is difficult to ensure that the bonding has sufficient strength to withstand these various stresses and not only is it expensive to rely upon bonding of such high quality but it is also likely to require frequent repair and maintenance. In fact, quite apart from strength requirements, the bonding is also required to maintain a complete seal between the body and the follower as the device is necessarily exposed to extreme working conditions and would otherwise be rendered inoperative by the ingress of foreign matter and moisture.

It is an object of the present invention to provide an improved form of coupling for a vibratory soil-compacting device that avoids the aforementioned difficulties.

SUMMARY OF THE INVENTION

According to the present invention, there is provided a soil-compacting device comprising a body containing a vibratory mechanism and a follower extending above the body and from which the body is arranged to be suspended by at least one flexible tension element such as a rope or cable, the body and follower having adjacent but spaced end portions between which flexible sealing means are disposed to enclose said end portions.

Preferably, said sealing means comprise a resilient device that is subjected to compression by said tension element or elements. Said device may take the form of a sleeve, with the body, follower and said sleeve having substantially the same external cross-sectional shape and forming a generally cylindrical assembly.

Advantageously, the sealing means are arranged also to limit or prevent relative rotation between the body and the follower.

The invention will now be described, by way of example only, with reference to the accompanying drawings.

DESCRIPTION OF THE PREFERRED EMBODIMENT

Figure 1:
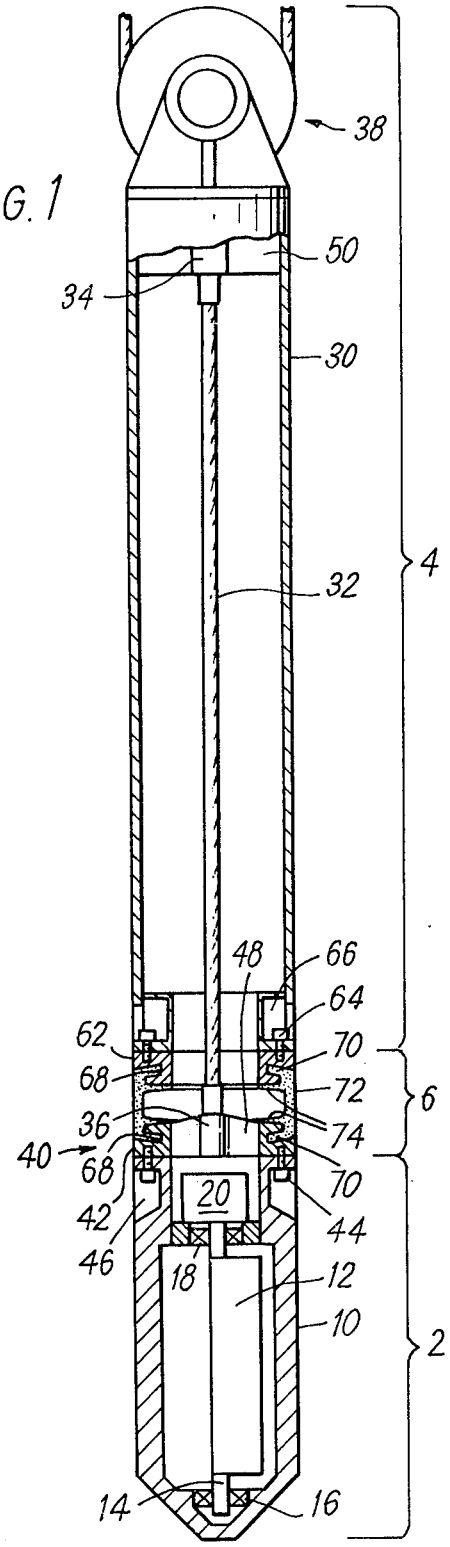
FIG. 1 illustrates in axial section a soil-compacting device according to the invention.

The device in FIG. 1 comprises a generally cylindrical vibrator unit 2 and a generally cylindrical follower 4 of the same diameter as and co-axial with the vibrator unit. Between the adjacent ends of the vibrator unit and follower there is a generally cylindrical sealing unit 6 coaxial with the vibrator unit and follower such that the device has a substantially uniform cross-section along most of its length.

The vibrator unit has a body 10 within which an eccentric 12 on a shaft 14 is supported by upper and lower bearings 16, 18 to be rotated by a hydraulic motor 20. The follower 4 comprises a tube 30, with a suspension pulley assembly 38 at its upper end.

The vibrator unit 2 is suspended from the follower 4 by a central wire rope or cable 32 the upper end 26 of which is fixed to a cable grip 34 near the top of the follower tube and the lower end 28 of which is fixed to a cable grip 36 on a carrier block 40 rigidly secured to end flange 22 of the vibrator body. The block has a ring portion 42 of the same diameter as the vibrator body 10 and is attached to the flange 22 by a series of set bolts 44 recessed in pockets 46 around the circumference of the body. The cable grip 36 is connected to the ring portion 42 of the carrier block by a series of radially-directed webs 48 and similar webs 50 extend between the upper cable grip 34 and the follower tube.

A ring member 62, similar in form to the ring portion 42 of the carrier block, is attached to flange 24 at the lower end of the follower tube, in inverted relation to the ring portion, by a series of set bolts 64 recessed in pockets 66 around the circumference of the follower tube. The ring portion 42 and the member 62 each have a slot 68 extending around their periphery and in the slots are located respective inwardly-projecting lips 70 of a fibre-reinforced rubber or rubber-like sealing sleeve 72 having substantially the same diameter as the vibrator unit and follower. An auxiliary peripheral lip 74 also projects inwards from the sleeve adjacent each lip 70 and so spaced therefrom that the pair of lips 74 cover the facing end surfaces of the ring portion 42 and member 62. The sleeve 72 is secured in place by bonding.

Hydraulic hoses extend through the follower tube and the sleeve 72 into the vibrator unit in known manner to the motor 20 but these can be arranged entirely conventionally and are omitted from the drawing for clarity. Hoses may also be provided to the tapered nose section of the vibrator unit for the supply of water under pressure as is sometimes employed to increase the rate of penetration.

In use, operation of the motor 20 to drive the eccentric 12 generates oscillation of the vibrator unit substantially in the manner of a conical pendulum. The flexible nature of the connection between the vibrator unit and the follower prevents or limits oscillatory movement of the follower, so reducing the effort required to obtain a given compaction effect in the soil through which the device is moving. In this respect, the cable itself will not transmit the oscillations, while the resilient material of the sleeve exercises a damping effect that attenuates the transmission of disturbing forces from the oscillation of the vibrator unit to the follower.

The cable 32 is pre-tensioned and is so arranged that with the device freely suspended from the pulley assembly the sleeve 72 is compressed axially. The form and construction of the sleeve 72 may be such as to give it a cylindrical outer surface when so compressed. Ground reaction will increase this compression as the apparatus is lowered into the soil, although local tensile stresses may appear transiently as the vibrator unit oscillates on the follower.

The sleeve 72 functions as a spacer between the vibrator unit and the follower whilst keeping them generally aligned with one another. Should the amplitude of oscillation of the vibrator unit 2 become excessive, the lips 74 on the sleeve prevent metal-to-metal contact.

The sleeve 72 also functions to prevent ingress of soil into the joint between the respective units 2 and 4 and by providing a smooth external connection between the units facilitates the penetration of the apparatus into the ground. In addition, bonding of the sleeve 72 to the ring portion 42 and the ring member 62 prevents relative rotation between vibrator and follower so as to preclude damage from such movement to the hoses extending into the vibrator unit.

Figure 2:
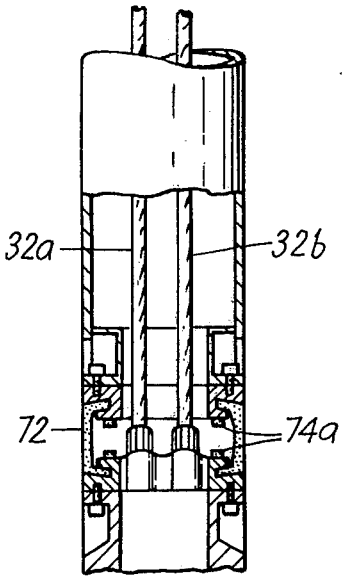
FIG. 2 is a detail axial section illustrating some modifications of the device in FIG. 1.

It is to be understood that modificatios of the apparatus described above are possible. In particular, the upper end of the cable or rope has been shown fixed near the top of the follower unit in order to facilitate access to the attachment point but other attachment locations are possible and as FIG. 2 illustrates it is possible to have more than one cable or rope 32*a*, 32*b* secured to similar upper and lower gripping members, only the lower gripping member 36*a* being shown. Also, it may be more convenient to form the lips 74 separately from the sleeve 72 or provide other separate resilient elements 74*a* having the same buffering effect as said lips.

What I claim and desire to secure by Letters Patent is:

1. A soil compacting device comprising, in combination a vibrator body and a follower disposed substantially in line and forming an elongate assembly with the body below the follower, a vibratory mechanism within the body for generating oscillations transverse to the longitudinal axis of the assembly, means suspending the body from the follower, said suspension means comprising at least one flexible tension element, respective end portions of the body and follower being adjacent but spaced from each other and flexible sealing means extending between and enclosing said end portions, said sealing means comprising a resilient member that is precompressed by the tension in said at least one flexible element.

2. A soil compacting device according to claim 1 wherein said resilient member is in the form of a sleeve, with the body, follower and said sleeve having substantially the same cross-sectional shape and forming a generally cylindrical assembly.

3. A soil compacting device according to claim 1 wherein said sealing means are torsionally resistant with respect to torques about the assembly longitudinal axis for restraining relative rotation between the body and the follower.

4. A soil compacting device according to claim 1 wherein respective ring-form members are attached by removable securing means at said end portions of the body and follower and said resilient member is secured in place by said ring-form members.

5. A soil-compacting device according to claim 4 wherein peripheral recesses are provided in said respective ring members, and inwardly projecting elements of said resilient member are located in said recesses.

6. A soil compacting device according to claim 4 wherein resilient means are interposed between facing surfaces of said ring-form members to keep the surfaces out of contact.

7. A soil compacting device according to claim 6 wherein said resilient means are integral with said resilient member.

8. A soil compacting device according to claim 1 wherein an upper gripping member is located adjacent the upper end of the follower, and said at least one flexible tension element has an upper end fixed to the follower through said gripping member.

9. A soil compacting device according to claim 8 wherein a lower gripping member is disposed on the body and said at least one flexible tension element has a lower end fixed to the body through said lower gripping member, said upper and lower gripping members holding said at least one flexible tension element spaced from side walls of the follower extending below said upper gripping member.

* * * * *